United States Patent [19]

Sullivan

[11] Patent Number: 4,893,481

[45] Date of Patent: Jan. 16, 1990

[54] CONVECTOR TRAY

[76] Inventor: John T. Sullivan, 3910 Madison St., Hyattsville, Md. 20781

[21] Appl. No.: 258,920

[22] Filed: Oct. 17, 1988

[51] Int. Cl.[4] ..... F25D 21/14

[52] U.S. Cl. ..... 62/291; 29/402.08

[58] Field of Search ..... 62/285, 286, 288, 289, 62/291; 29/402.03, 402.08; 165/70

[56] References Cited

U.S. PATENT DOCUMENTS

| | | | |
|---|---|---|---|
| 2,019,091 | 10/1935 | Philipp | 62/285 X |
| 2,896,426 | 7/1959 | Ayling | 62/285 |
| 3,498,078 | 3/1970 | Sharp et al. | 62/285 X |
| 3,750,418 | 8/1973 | Mauldin | 62/285 X |
| 4,597,269 | 7/1986 | Kim | 62/286 |
| 4,712,382 | 12/1987 | LeClear | 62/291 X |
| 4,783,971 | 11/1988 | Alba | 62/291 |

FOREIGN PATENT DOCUMENTS

| | | | |
|---|---|---|---|
| 52-455 | 4/1977 | Japan | 62/285 |

OTHER PUBLICATIONS

"Introducing CAPCO's New Convector Trays . . . " (3 pages).

*Primary Examiner*—William E. Tapolcai

*Attorney, Agent, or Firm*—Diller, Ramik & Wight

[57] ABSTRACT

A convector tray including a one-piece, homogeneous in situ molded tray body of polymeric/copolymeric material, the tray body including a bottom wall and a peripheral edge defining a condensation chamber which opens upwardly when the convector tray is installed in generally surrounding relationship to a pipe conducting a heat exchange medium thereto for like condensate creating elements, a bottom wall including an upper and outer lower surfaces, a wall projecting above said inner upper surface and having an end remote therefrom closed by a removable wall portion which when removed defines an opening, a discharge spout for discharging condensate deposited/collected in the tray body, and the material of the tray body being constructed and arranged from material having a strength and thickness to permit severance along and through the peripheral edge and into the opening to thereby create an access slot through which a heat exchange medium conducting pipe is adapted to pass for insertion into the opening.

29 Claims, 2 Drawing Sheets

CONVECTOR TRAY

BACKGROUND OF THE INVENTION

Residential and commercial air conditioners include as a part thereof heat exchangers which in turn include pipes through which coolant (liquid or gas) is pumped and upon which air condenses forming condensate. If left unattended, the condensate creates innumerable problems as it drips, forms and/or collects, such as creating rust, blocking normal drainage ports which results in fungus growth and attendant odors, overflow and damage, etc. Accordingly, it has been the conventional practice to collect such condensate, generally as it forms, in convector trays made from galvanized metal. Galvanized metal convector trays will, of course, rust with relative ease which in turn creates blockage of the drain ports thereof and the latter creates the problems heretofore noted, namely, dripping, blockage, overflow, fungus growth, undesirable odors, etc. It is therefore necessary to replace such rusted convector trays, but if replaced by similar galvanized convector trays, the immediate problem is solved but the long term problems remain. Furthermore, a particular problem arises when the galvanized metal convector trays are part of original installations in which pipes containing refrigerant or coolant pass through openings in the convector trays or the convector trays have peripheral slots which accommodate such refrigerant pipes.

In the case of refrigerant pipes passing through openings of conventional galvanized metal convector trays, the rusted trays are removed by simply cutting the trays into pieces and removing the trays from their installed positions surrounding the coolant pipes. In the convector trays which have a slot in the peripheral edge, these trays can also be cut and removed, but at times they can be bent and removed because of adequate working room. The removal of the convector trays is quite simple, but replacing the old convector trays with new convector trays creates a problem which heretofore has been solved by disconnecting the coolant pipes, reinserting the cooling pipes through the openings and/or in the slots of the new convector trays and reconnecting the pipes. This approach to the removal and replacement of the convector trays is extremely time consuming and costly.

SUMMARY OF THE INVENTION

The present invention is directed to a novel convector tray which overcomes the disadvantages latter-noted and particularly renders unnecessary the time consuming and costly procedure of disconnecting and reconnecting pipes or other elements when removing and/or reinstalling convector trays. In accordance with the present invention, a convector tray is provided which is defined by a tray body constructed from a single piece of in situ molded polymeric/copolymeric material having a peripheral edge and defining a generally upwardly opening condensate chamber. An outlet discharges condensate from the condensate chamber, and a wall portion projects upwardly from the condensate chamber and is preferably of a generally frusto-conical or conical configuration. A wall closing an end of the frusto-conical wall portion can be removed to form an opening, and the peripheral edge of the convector tray is constructed of material and thickness which can be readily cut or severed through the peripheral edge and into this opening to form an access slot through which the coolant pipe can pass for subsequent reception in the opening. Once the pipe is positioned in the opening, appropriate sealing material/caulking compound is applied along the severance line and around the opening and the associated portion of the pipe passing therethrough. Thus, the pipe need not be disconnected and reconnected, and as condensate forms thereon it will drip, flow and eventually collect in the condensate chamber and continuously flow therefrom through the discharge passage. In this manner the conventional galvanized metal convector trays can be removed by cutting/bending/distorting, yet the pipes need not be disconnected/reconnected during installation of the convector trays of the present invention thereby saving considerable time, effort and expense.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
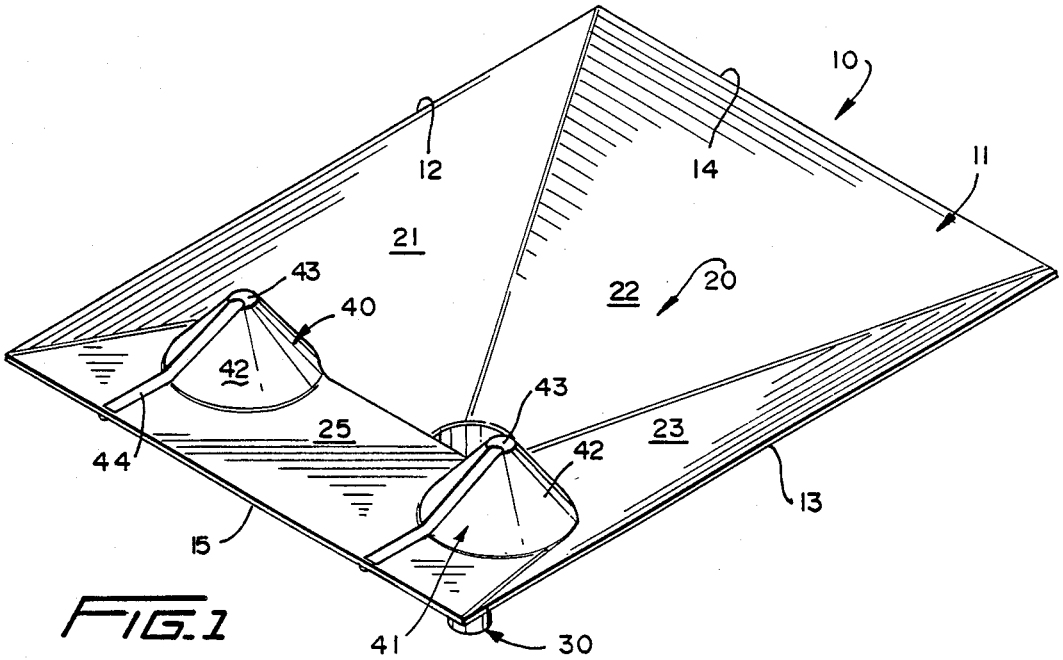
FIG. 1 is a top perspective view of a novel convector tray constructed in accordance with this invention, and illustrates a tray body having an upwardly opening condensate chamber, a discharge spout in a bottom wall, and two generally conical/frusto-conical upwardly diverging walls each having a shallow upwardly opening channel associated therewith.

A novel convector tray constructed in accordance with this invention is generally designated by the reference numeral 10 and includes a tray body 11 constructed from in situ vacuum molded polymeric/copolymeric material, such as high-impact polystyrene, flexible polyethylene or impact-resistant ABS. The latter materials eliminate rust build-up and reduce drain and condensate discharge port clogging due to mineral deposits, and also reduces/eliminates fungus growth.

Figure 3:
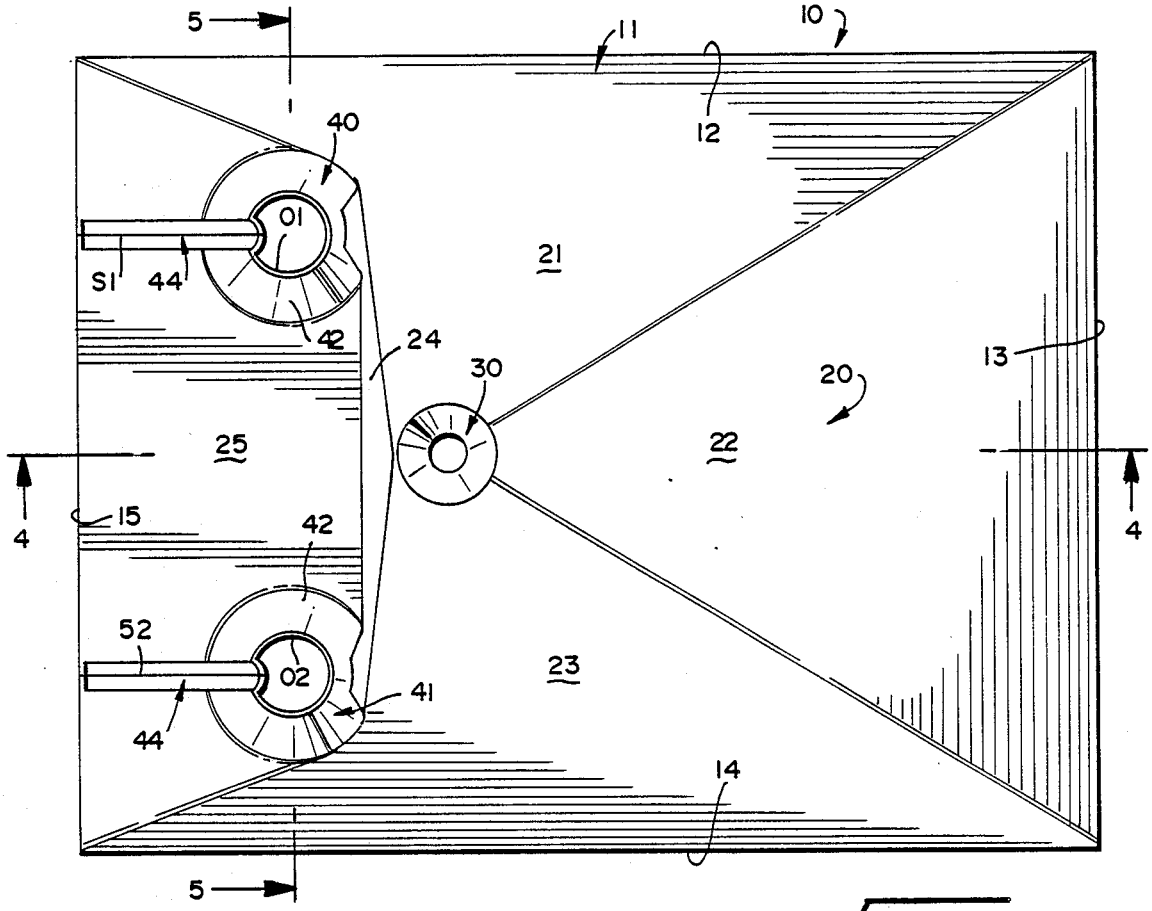
FIG. 3 is a top plan view of the convector tray and illustrates details of the overall configuration thereof.

The tray body 11 is generally of a rectangular configuration, as defined by a peripheral edge portion which is in turn defined by side edges 12, 13, a front edge 14 and a rear edge 15. The edges 12–15 bound an upwardly opening condensate chamber 20 which is formed by four generally triangular walls 21–24 (FIG. 3) and a generally trapezoidal wall 25. The generally triangular walls 21–24 converge toward each other and toward means 30 in the form of a discharge spout for effecting the passage/discharge of condensate from the condensate chamber 20 to a drain pipe (not shown) connected to a cylindrical end 31 of the discharge spout 30 after an end wall 32 (FIG. 4) has been cut away to leave an edge 33 (FIG. 5). The end wall 32 is formed during the conventional vacuum molding process, as is well known in the art. The discharge spout 30 thus forms somewhat of a gradual transition from and a continuation of the generally triangular walls 21–24 and projects considerably beneath and away from a bottom outer surface 34 (FIG. 4) of the condensate chamber 20.

During the in situ vacuum molding heretofore noted, the polymeric/copolymeric material in the area of the top wall 25 is formed into two means for defining a removable access area through which a pipe conducting coolant/heat exchange medium is adapted to pass, and each of the identical access area means are identified by the reference numerals 40, 41. Though two such means 40, 41 are shown, it is to be understood that more or less can be provided depending upon the particular installation into which the convector tray 10 will be installed as a replacement for an existing convector tray.

Figure 4:
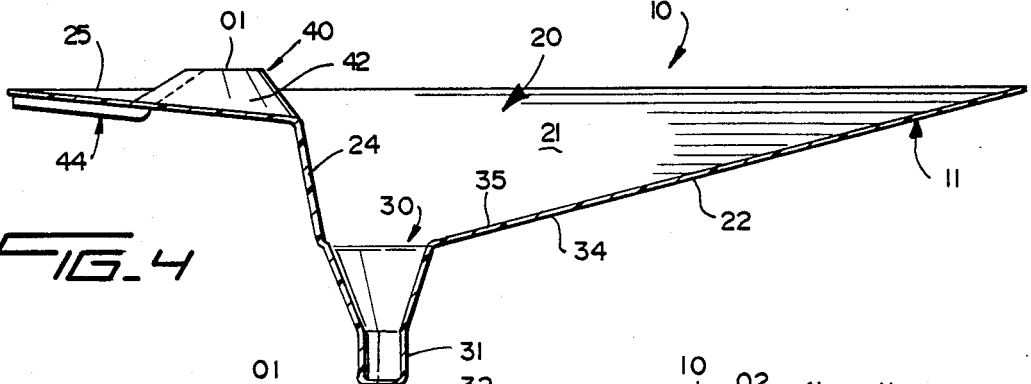
FIG. 4 is a cross sectional view taken generally along line 4—4 of FIG. 3, and illustrates the overall configuration of the tray body, one of the frusto-conical/conical walls and the discharge spout.
Figure 5:
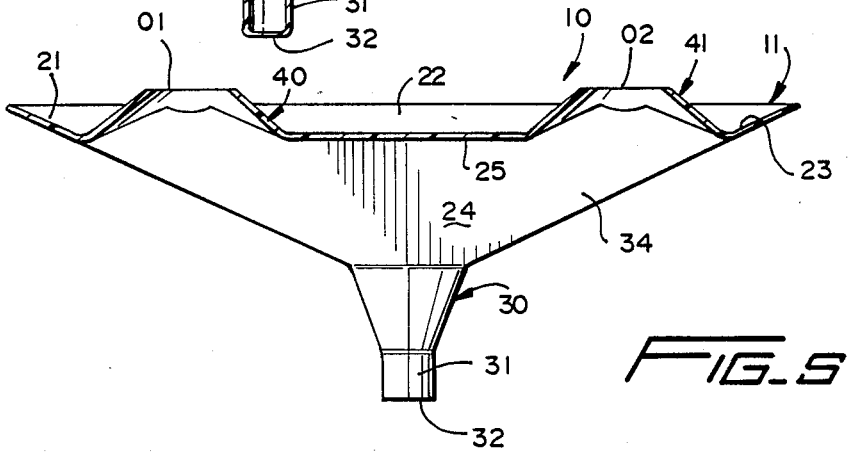
FIG. 5 is a cross sectional view taken generally along line 5—5 of FIG. 3, and illustrates the cross sectional configuration of the frusto-conical/conical walls.

Each of the means 40, 41 includes a generally frusto-conical or conical wall 42 which converges upwardly in a direction away from a bottom innermost surface 35 of the condensate chamber 20 and the trapezoidal wall 25 (FIGS. 1, 4 and 5). Each of the frusto-conical/conical walls 42 is closed by an end wall 43. Means, generally designated by the reference numeral 44, is provided both to define an area of severance along which the tray body 11 is to be severed/cut inboard of the edge 15, as will be described more fully hereinafter, as well as to define a generally shallow upwardly opening channel for accommodating sealant/sealing compound during installation of the convector tray 10. Each generally shallow upwardly opening channel 44 extends from the edge 15 along the trapezoidal wall 25 and along the frusto-conical/conical wall 42 ending at the associated end wall 43.

During the conventional in situ vacuum molding of the convector tray 10, a heated sheet of plastic material is vacuum formed between opposing dies each having a cavity the mirror image of the top and bottom of the tray body 11. During this vacuum molding process the tray body 11 is not only vacuum-formed, but the end walls 42 and 43 are integrally formed therewith. As was earlier noted, the end wall 32 (FIG. 4) can be removed to connect a drain pipe (not shown) to the cylindrical portion 31 of the discharge spout 30 after, of course, the convector tray 10 has been installed.

Figure 2:
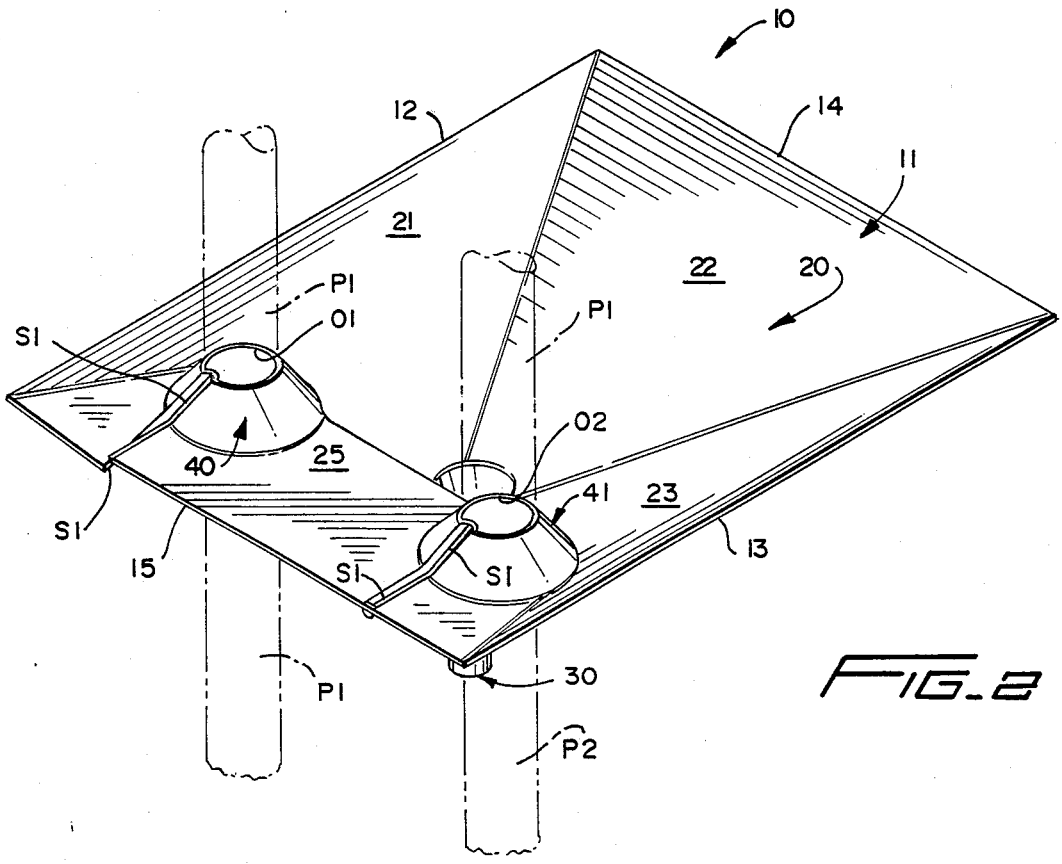
FIG. 2 is a top perspective view of the convector tray of FIG. 1 and illustrates the convector tray in its installed position after upper portions of the frusto-conical/conical walls have been removed to form an opening and a cutline has been formed in the tray between the peripheral edge and each opening defining an access slot through which pipes, shown in phantom outline, can pass for insertion into the openings during the assembly of the convector tray.

In order to describe the manner of installation of the convector tray 10, reference is made to FIG. 2 which illustrates in phantom outline a pair of vertical, generally parallel elements in the form of pipes P1, P2 through which pass a heat exchange medium/coolant. These pipes P1, P2 are generally part of an overall commercial (or residential) heat exchange system for effecting heating or cooling thereof. In commercial heat exchange systems, the pipes P1, P2 can run several stories and have innumerable connections (soldered, brazed and/or threaded) along the overall total length thereof. During original installation of galvanized convector trays, the galvanized convector trays are simply place adjacent such pipes P1, P2 and at times the periphery of the galvanized tray is recessed ($3\frac{3}{4}'' \times 1\frac{3}{8}''$ is typical) for accommodating pipes, bolts or similar elements upon which condensate may form. When thus fitted, appropriate caulking/sealing compound is applied between the pipes and the edges of the galvanized tray recesses to assure that collected condensate will flow into the convector tray and be appropriately drained therefrom. Obviously, when such galvanized convector trays are originally installed, little concern is given to the subsequent removal thereof, and as is most often the case, the trays must be bent, cut and/or otherwise damaged and distorted in order to remove the same from the involved areas. This does not create any particular problem since the galvanized trays are useless and destroying the same for removal purposes is quite acceptable. However, the problem addressed and solved by the present convector tray construction is the installation of the convector tray 10 into such limited areas and, where necessary and desirable, in surrounding relationship to the heat exchange pipes P1, P2, particularly where there is limited access for tray manipulation during installation.

After the galvanized metal convector tray has been removed, one merely determines the outside diameter of the pipes P1, P2 and the spacing therebetween and selects a convector tray 10 having a comparable spacing between the means 40 and 41 and frusto-conical walls 42 which between their maximum and minimum diameters will accommodate the diameter of the pipes P1, P2. Having selected an appropriate convector tray 10, the workman now merely cuts away each of the walls 43 and an upper portion of each frusto-conical wall 42 to create an opening 01, 02 (FIG. 2) of a diameter corresponding to the diameter of the respective pipes P1, P2. The workman then cuts or severs the tray body 11 from the peripheral edge 15 along a severance line S1, S2 inboard along the trapezoidal wall 25, along each of the remaining portions of the frusto-conical walls 42, and along the channels 44 into the openings 01, 02, respectively. When the now severed frusto-conical wall 25 is flexed an access slot S1 (FIG. 2) is defined by the severance line S1 and a like access slot S2 is formed by the severance line S2. The workman now merely slides the convector tray 10 upon each of the pipes P1, P2 with the latter pipes sliding freely through the expanded access slots S1, S2. The slots S1, S2 are spread quite easily by simply pulling the portionsof the frusto-conical wall 25 to each side of the slots S1, S2 away from each other which spreads the slots S1, S2 and temporarily deforms the openings 01, 02 into somewhat open ovals. Once the pipes P1, P2 are received in these temporary oval shaped openings 01, 02, the normal resiliency of the polymeric/copolymeric material of the tray body 11 rebounds the frusto-conical wall 25 generally to the position shown in FIG. 2 after which sealant/sealing compound/caulking compound can be applied in and along the channels 44 over the severance lines S1, S2 and around the edges of the openings 01, 02 and the associated pipes P1, P2 to assure that any condensate formed upon and dripping down the pipes P1, P2 will flow into the condensate chamber 20 and be discharged therefrom. Hence, once the conventional convector trays have been removed, the convector tray 10 can be quickly, easily and inexpensively installed relative to pipes P1, P2 without the uncoupling/disassembly and recoupling/reassembly thereof which results in installation/labor costs at a fraction of those heretofore required when the pipes P1, P2 had to be disassembled. Hence, though the convector tray 10 is relatively inexpensive to manufacture due to its construction from polymeric/copolymeric material by in situ vacuum forming, the savings created by the novel construction heretofore noted which achieves the heretofore long-felt yet unsolved need of replacing useless galvanized convector trays quickly and at low cost is a major advantage of the invention.

Variations in the convector tray 10 may be made in accordance with this invention, and as was heretofore noted, more or less than the two illustrated means 40, 41 can be provided and the shape and configuration thereof can vary. In the preferred embodiment, the frusto-conical/conical configuration of the walls 42 permitted the convector tray 10 to be utilized with a range of diameters of the pipes P1, P2 simply by selectively removing a particular portion of the frusto-conical walls 42 to form a particular diameter of the openings 01, 02. For example, if the frusto-conical walls 42 had a maximum diameter of two inches, the convector tray 10 could be utilized with pipes P1, P2 of diameters two inches and less. The next sized walls 42 might then range from a maximum diameter of three inches to a minimum diameter at the end walls 43 of two inches to accommodate another range of the outside diameters of the pipes P1, P2. Furthermore, in many installations a particular problem may not involve pipes P1, P2 but other ancillary equipment, such as bolts, fan housings, etc., and in such cases single means 40, 41 might be provided, but the frusto-conical walls 42 might be more of a rectangular or box-like configuration to receive therein polygonally shaped elements upon which condensate may form. However, irrespective of the particular configuration of the means 40, 41, the underlying importance is the provision of a removable area or wall portion to form an associated opening (01/02) and effect severance (S1, S2) to permit passage of the tray 10 upon the particular condensate creating element.

Although a preferred embodiment of the invention has been specifically illustrated and described herein, it is to be understood that minor variations may be made in the apparatus without departing from the spirit and scope of the invention, as defined in the appended claims.

I claim:

1. A convector tray comprising a tray body constructed from polymeric/copolymeric material, said tray body including a bottom wall and a peripheral edge portion defining a condensation chamber, means for effecting the passage of condensate through said bottom wall upon the utilization of said convector tray with an associated heat exchange medium, wall means inboard of said peripheral edge portion for defining a removable access area through which a pipe conducting a heat exchange medium is adapted to pass, and means for peripherally introducing a pipe into said access area upon the removal of said access area.

2. The convector tray as defined in claim 1 wherein said removable access area defines an opening upon the removal thereof from said bottom wall.

3. The convector tray as defined in claim 1 including means for defining a line generally along which said bottom wall can be severed across said peripheral edge portion to said removable access area whereby a heat exchange medium conducting pipe can be inserted into an opening of said bottom wall formed upon the removal of said removable access area.

4. The convector tray as defined in claim 1 wherein said removable access area means is a generally conical wall whereby openings of different sizes can be created to accommodate the passage therethrough of different sizes of heat exchange medium conducting pipes or the like.

5. The convector tray as defined in claim 1 wherein said bottom wall is of an upwardly opening generally concave configuration, and said removable access area means is a generally conical wall converging upwardly and away from said bottom wall.

6. The convector tray as defined in claim 1 wherein said bottom wall includes an upper surface and a lower surface, and said removable access areas means is defined by a wall projecting beyond said upper surface.

7. The convector tray as defined in claim 1 wherein said bottom wall includes an upper surface and a lower surface, said removable access area means is defined by a wall projecting beyond said upper surface, and said condensate passage means is a condensate discharge spout which projects beyond said lower surface.

8. The convector tray as defined in claim 1 wherein said bottom wall includes an upper surface and a lower surface, said removable access area means is defined by a wall projecting beyond said upper surface, said condensate passage means is a condensate discharge spout which projects beyond said lower surface, and said discharge spout is closed by a wall portion at an end of said discharge spout remote from said lower surface which is adapted to be removed to effect condensate discharge therethrough.

9. The convector tray as defined in claim 2 including means for defining a line generally along which said bottom wall can be severed across said peripheral edge portion to said removable access area whereby a heat exchange medium conducting pipe can be inserted into an opening of said bottom wall formed upon the removal of said removable access area.

10. The convector tray as defined in claim 3 wherein said removable access area means is a generally conical wall whereby openings of different sizes can be created to accommodate the passage therethrough of different sizes of heat exchange medium conducting pipes or the like.

11. The convector tray as defined in claim 3 wherein said bottom wall is of an upwardly opening generally concave configuration, and said removable access area means is a generally conical wall converging upwardly and away from said bottom wall.

12. The convector tray as defined in claim 3 wherein said bottom wall includes an upper surface and a lower surface, and said removable access areas means is defined by a wall projecting beyond said upper surface.

13. The convector tray as defined in claim 3 wherein said bottom wall includes an upper surface and a lower surface, said removable access area means is defined by a wall projecting beyond said upper surface, and said condensate passage means is a condensate discharge spout which projects beyond said lower surface.

14. The convector tray as defined in claim 3 wherein said bottom wall includes an upper surface and a lower surface, said removable access area means is defined by a wall projecting beyond said upper surface, said condensate passage means is a condensate discharge spout projects beyond said lower surface, and said discharge spout is closed by a wall portion at an end of said discharge spout remote from said lower surface which is adapted to be removed to effect condensate discharge therethrough.

15. The convector tray as defined in claim 1 wherein said wall means is disposed in a manner such that the removable access area passes a pipe therethrough in generally upright relationship to said bottom wall.

16. The convector tray as defined in claim 1 wherein upon the removal of said access area an opening is defined having an axis generally normal to said bottom wall.

17. The convector tray as defined in claim 1 wherein said wall means is in said bottom wall.

18. The convector tray as defined in claim 17 wherein said wall means is disposed in a manner such that the removable access area passes a pipe therethrough in generally upright relationship to said bottom wall.

19. The convector tray as defined in claim 17 wherein upon the removal of said access area an opening is defined having an axis generally normal to said bottom wall.

20. a convector tray comprising a one-piece generally homogeneous in situ molded polymeric/copolymeric material tray body defining an upwardly opening condensate chamber, said condensate chamber being defined by an upper surface and a lower surface, a spout projecting beyond said lower surface, a wall closing said spout at an end remote from said lower surface whereby upon the removal of said wall condensate deposited in said condensate chamber will be discharged therefrom through said spout, and means projecting above said upper surface and defining a removable access area through which a pipe conducting a heat exchange medium is adapted to pass.

21. The convector tray as defined in claim 20 wherein said removable access area defines an opening upon the removal thereof from said bottom wall.

22. The convector tray as defined in claim 20 including a peripheral edge bounding said tray body, and a line of severance between said peripheral edge and said removable access area through which a pipe conducting a heat exchange medium is adapted to pass for insertion into said removable acess area upon the removal thereof.

23. The convector tray as defined in claim 22 wherein said removable access area defines an opening upon the removal thereof from said bottom wall.

24. A convector tray comprising a tray body defining an upwardly opening condensate chamber, a peripheral edge bounding said tray body, means for discharging condensate deposited in said condensate chamber, means inboard of said peripheral edge for defining an access area through which a pipe conducting a heat exchange medium is adapted to pass, and a line of severance between said peripheral edge and said access area through which a pipe conducting a heat exchange medium is adapted to pass for insertion into said access area.

25. A convector tray comprising a tray body defining an upwardly opening condensate chamber, a peripheral edge bounding said tray body, means for discharging condensate deposited in said condensate chamber, means inboard of said peripheral edge for defining an access area, an element projecting through said access area, a line of severance between said peripheral edge and said access area, and sealing means along said line of severance and along a contiguous portion of said element and said access area to prevent condensate leakage. projecting through

26. The convector tray as defined in claim 25 wherein said access area is an opening.

27. The convector tray as defined in claim 25 wherein said line of severance is formed in a channel extending between said peripheral edge and said access area.

28. The convector tray as defined in claim 26 wherein said line of severance is formed in a channel extending between said peripheral edge and said access area.

29. The convector tray as defined in claim 25 wherein said element is a pipe.

* * * * *